United States Patent [19]

Church

[11] Patent Number: 4,806,254

[45] Date of Patent: Feb. 21, 1989

[54] COMPOSITION AND METHOD FOR REMOVAL OF WRINKLES IN FABRICS

[75] Inventor: John A. Church, Princeton Junction, N.J.

[73] Assignee: Colgate-Palmolive Co., Piscataway, N.J.

[21] Appl. No.: 54,350

[22] Filed: May 26, 1987

[51] Int. Cl.[4] ..... D06M 1/00

[52] U.S. Cl. ..... 252/8.6; 252/8.8; 252/170; 252/171; 252/174.15; 252/DIG. 13; 252/DIG. 14; 8/120; 427/242

[58] Field of Search ..... 252/8.6, 170, 171, DIG. 14, 252/DIG. 13, 174.15; 427/242

[56] References Cited

U.S. PATENT DOCUMENTS

| | | | |
|---|---|---|---|
| 2,789,379 | 4/1957 | Edwards | 38/144 |
| 3,436,772 | 4/1969 | Stebbins | 8/149.2 |
| 3,600,325 | 8/1971 | Kaufman et al. | 252/305 |
| 3,650,816 | 3/1972 | Rudy et al. | 117/109 |
| 3,992,332 | 11/1976 | Zenon | 252/8.8 |
| 4,082,500 | 4/1978 | Ward et al. | 8/120 |
| 4,087,240 | 5/1978 | Reinert et al. | 8/1 W |
| 4,127,694 | 11/1978 | Murphy et al. | 428/245 |
| 4,139,661 | 2/1979 | Anagnostis et al. | 427/401 |
| 4,242,377 | 12/1980 | Roberts et al. | 252/8.6 |
| 4,460,489 | 7/1984 | Kendall | 252/90 |
| 4,491,539 | 1/1985 | Hoskins et al. | 252/541 |
| 4,541,936 | 9/1985 | Ona et al. | 252/8.6 |
| 4,661,268 | 4/1987 | Jacobson et al. | 252/8.8 |

FOREIGN PATENT DOCUMENTS

| | | |
|---|---|---|
| 289907 | 5/1915 | Fed. Rep. of Germany . |
| 10729 | 7/1893 | United Kingdom . |
| 21976 | 11/1894 | United Kingdom . |

*Primary Examiner*—Paul Lieberman
*Assistant Examiner*—Ronald A. Krasnow
*Attorney, Agent, or Firm*—Bernard Lieberman; Donna R. Fugit; Murray M. Grill

[57] ABSTRACT

An aqueous composition is provided for removing wrinkles from a fabric or garment comprising:

(a) from about 10 to 60%, by weight, of one or more alcohols selected from the group consisting of ethyl, propyl and isopropyl alcohols;

(b) from about 1 to 10%, by weight, of glycerine;

(c) a nonionic surfactant in an amount sufficient to enhance the wettability of the fabric, and;

(d) the balance water

The process of using the de-wrinkling composition comprises spraying the composition on the wrinkled fabric or garment and then allowing same to dry.

15 Claims, No Drawings

COMPOSITION AND METHOD FOR REMOVAL OF WRINKLES IN FABRICS

BACKGROUND OF THE INVENTION

This invention relates to compositions and methods for removing wrinkles from fabrics or garments.

A variety of methods and treatments are known in the textile art for the urpose of removing wrinkles from fabrics. One well-known method involves the application of heat and pressure as is commonly done in household ironing. The combination of heat with moisture in the form of steam is another well-known method for wrinkle-removal and has the advantage of partially eliminating the need for the application of pressure.

Methods employing heat and pressure for the removal of wrinkles are effective but suffer from the disadvantage of requiring specialized equipment, such as irons and presses. Consequently, they are not sufficiently convenient or practical for use in situations where auxiliary equipment is not available or the use of such equipment is too time-consuming such as, during travel. Furthermore, heat may be potentially damaging to the fabric. Steam dewrinkling presents similar disadvantages, requiring the use of an electric steam generating apparatus for the purpose of contacting the wrinkled fabric with moist heat.

Compositions and methods which remove wrinkles without the use of heat or steam and without a need for extensive equipment have been suggested in the prior art. U.S. Pat. No. 3,436,772 to Stebbins discloses a composition for dewrinkling fabrics which comprises a low molecular weight alcohol and water. The inclusion into the composition of small amounts of a glycol such as propylene glycol and minor ingredients such as acetone, is optional.

Kaufman and Martin (U.S. Pat. No. 3,600,325) disclose a fabric dewrinkling composition consisting of alcohol and water. The inclusion of a surfactant in the composition is to be avoided according to the patentees because it is considered troublesome. The de-wrinkling composition is applied to the fabric as an aerosol spray from a pressurized container.

The de-wrinkling compositions disclosed in U.S. Pat. No. 3,674,688 to Schwartz et al comprise alcohol and water in combination with a small amount of a cationic surfactant, preferably a quaternary ammonium compound. The cationic surfactant serves to penetrate and wet the fabric according to the patentees. Such a composition is further modified as disclosed in U.S. Pat. No. 4,661,268 to Jacobson et al by addition of a silicone-glycol copolymer and/or a fluorinated alkyl ester surfactant to improve the wetting characteristics of the composition.

SUMMARY OF THE INVENTION

The present invention provides a composition for removing wrinkles from a fabric or garment, which composition is an aqueous solution comprising:

(a) from about 10 to 60%, by weight, of an alcohol selected from the group consisting of ethyl, propyl and isopropyl alcohols;

(b) from about 1 to 10%, by weight, of glycerine;

(c) a nonionic surfactant in an amount sufficient to enhance the wettability of the fabric, and;

(d) the balance water

In accordance with the process of the invention, the removal of wrinkles from a fabric is effected by contacting the wrinkled fabric or garment to be treated with an effective amount of the above-identified aqueous solution provided in the form of a spray of finely divided particles to the surface of the fabric. The treated fabric is then allowed to dry in the ambient, leaving a dry, smooth, wrinkle-free fabric.

A mist or spray of finely divided droplets of the composition is provided using methods well known in the art. A conventional pump sprayer is suitable or alternatively a hydrocarbon propellant may be incorporated into the de-wrinkling composition to allow application of the composition under pressure from an aerosol spray container.

In a preferred embodiment the de-wrinkling composition additionally contains at least 0.05%, by weight, of a silicone compound to reduce any slight tackiness of the treated fabric which may otherwise occur as a result of its being contacted with glycerine.

In a particular embodiment of the process of the invention, removal of wrinkles from garments is effected during a laundering operation by spraying a modified de-wrinkling composition upon damp laundered fabrics immediately prior to or during the drying cycle of an automatic laundry dryer. In accordance with this embodiment, the modified de-wrinkling composition is essentially comprised of two components: a glycerine-water solution containing from about 5 to 40%, glycerine, by weight, and preferably from about 10 to 30%, by weight. Accordingly, it is preferred that such modified de-wrinkling composition which is particularly formulated for use in an automatic clothes dryer not contain an alcohol or a nonionic surfactant. The presence of alcohol in an operating dryer presents a possible flammability or explosion hazard, and in addition, is not necessary to facilitate drying insofar as the heat and forced air flow from the dryer are normally sufficient to dry the damp fabrics at an acceptable rate. The nonionic surfactant which ordinarily serves to enhance the wettability of wrinkled fabrics, particularly dense garments such as, coats and jackets, will often not be needed to treat garments commonly found in wash loads predominantly comprised of relatively easy-to-wet garments such as shirts and blouses. Hence, the nonionic surfactant is optionally deleted from the composition when practicing this embodiment of the method of the invention.

The invention is predicated upon the discovery that glycerine when used in a composition in accordance with the invention is an effective fabric de-wrinkler when applied to a wide variety of natural and synthetic fabrics. In addition, glycerine provides a residual wrinkle resistant effect which reduces the tendency of the treated fabric to rewrinkle and makes subsequent ironing easier.

While glycerine is known in the textile manufacturing art for finishing fabrics, and in the paper manufacturing art as a softener of cellulosic fibers, its properties with regard to the de-wrinkling of fabrics have heretofore gone unrecognized.

DETAILED DESCRIPTION OF THE INVENTION

The de-wrinkling compositions of the invention are comprised of about 10% to 60% of one or more alcohols selected from the group consisting of ethyl, propyl and isopropyl alcohols. Ethyl alcohol is generally preferred. The proportion of alcohol in the composition is usually selected to provide the desired rapid-drying of the treated garments. A percentage by weight of from about 15 to 35% alcohol is usually preferred.

Glycerine is an essential component of the composition which in combination with the alcohol and water provides for the de-wrinkling of the treated garment or fabric. An effective amount of glycerine is usually from about 1 to 10%, by weight, of the composition. At levels of glycerine above 10%, the treated surface of the fabric, if oversprayed locally, may become unduly sticky or tacky with no accompanying improvement in de-wrinkling. A range of from 2 to 6%, by weight, glycerine is particularly useful, with a level of about 2% being especially preferred from the standpoint of product formulation expense, effective de-wrinkling and smoothness of the treated fabric, and applicability to both washable and non-washable fabrics. Where it is desired to provide a formulation for use on washable fabrics, such as cotton and cotton-polyester blends, it is advantageous in some instances to increase the glycerine content to as high as 10% to obtain superior de-wrinkling performance. The glycerine thus deposited on the fabric is completely removed when the fabric is laundered, glycerine being highly water-soluble.

The nonionic surfactant serves to improve the wettability of the wrinkled fabric by the aqueous composition. The nonionic surfactant is preferably selected from among primary alcohol ethoxylates, secondary alcohol ethoxylates or alkyl phenol ethoxylates. The primary alcohols ethoxylates are represented by the general formula:

$$R—O—(CH_2—CH_2—O)n—H$$

wherein R is an alkyl radical having from 9 to 16 carbon atoms and the number of ethoxylate groups, n, is from 1 to 7. Commercially available nonionic surfactants of this type are sold by Shell Chemical Company under the tradename Neodol and by Union Carbide Corporation under the tradename Tergitol.

The alkyl phenol ethoxylates include the condensation products of alkylphenol having an alkyl group containing from about 8 t 10 carbon atoms in either a straight chain or branched chain configuration with ethylene oxide, said ethylene oxide being present in an amount of 4 to 15 moles of ethylene oxide per mole of alkyl phenol. Commercially available nonionic surfactants of this type include Tergitol NP surfactant sold by Union Carbide Corporation and Igepal surfactants sold by GAF Corporation. Igepal CO-630 is a preferred surfactant for the present compositions.

The proportion of nonionic surfactant in the composition will generally be at least 0.01%, andd preferably in the range of 0.01 to 0.2%, by weight of the composition. It will be appreciated that even higher levels of nonionic surfactant will be functional in the compositions of the invention but may result in foaming on the surface of the fabric when the composition is applied as a spray. While foaming may be perceived by consumers to be an unpleasant characteristic, it has no adverse effect on the de-wrinkling performance of the composition.

The de-wrinkling composition is advantageously applied to the surface of the wrinkled fabric in the form of a mist or spray of finely divided particles. This may be effected conveniently by packaging the composition in a pressurized aerosol can which includes a hydrocarbon propellant. Alternatively, a hand or pump sprayer may be used. When packaged in an aerosol container, the de-wrinkling compositions will include from about 1 to 10%, of a hydrocarbon propellant, preferably from about 2 to 5%, and most preferably about 3%, by weight. A suitable propellant is propane or isobutane or mixtures thereof.

The composition is conveniently applied to a wrinkled garment by hanging the garment in the desired shape and then spraying the wrinkled area with a fine mist or spray of the composition using an amount sufficient to wet the garment but not saturate it. To assist in removing wrinkles, the sprayed area can be stretched or brushed lightly with the hand and allowed to dry. Drying of the fabric in the ambient generally occurs in about 5 to 20 minutes.

The de-wrinkling composition may be applied to individual garments as needed to restore their fresh appearance after wrinkling occurs, such as during travel, or alternatively it may be applied as a processing step during laundering or drying in household fabric care equipment. In accordance with this embodiment of the invention, the de-wrinkling composition is applied to the garments being laundered at the end of the rinse cycle or in the drying cycle of the laundering operation. This can be carried out by hand by spraying the individual garments as described above. Alternatively, the composition may be applied to laundered garments simultaneously with drying in an automatic clothes dryer using a dispenser capable of providing a spray or mist of the de-wrinkling composition during the drying cycle. Examples of suitable dispensers for this purpose are described in U.S. Pat. Nos. 3,364,585; 3,180,037; 3,114,653; and 3,872,604.

A silicone compound is a preferred additive to the de-wrinkling composition of the invention for the purpose of reducing surface friction and providing a smooth feel to the treated fabric. The silicone compound is preferably added in an amount of at least 0.05%, by weight, of the composition to reduce the tacky feel that otherwise may be imparted by glycerine to the fabric or garment surface, particularly in the case of heavy local overspraying. Useful liquid silicone compounds for this purpose are polydimethylsiloxane polymers commonly referred to as Dimethicone, one such silicone compound being sold by Dow Corning as "DC 225" Silicone Fluid for use in products such as skin creams, anti-perspirants and hair preparations.

It will be readily appreciated that minor components which are compatible with the above-described de-wrinkling composition may be included in such composition for aesthetic or other purposes without affecting its effectiveness as a de-wrinkling composition. Such additional components may include, but are not limited to, fragrances and processing aids such as are commonly used in household products.

The compositions of the invention are preferably prepared by mixing the water, glycerine and surfactant components (Part A) separately from the alcohol, silicone and optional minor components (Part B). Parts A and B are then mixed with stirring.

The following examples are intended to illustrate various embodiments of the invention, but are not intended to limit its scope.

EXAMPLE 1

A composition in accordance with the invention described below, was tested for wrinkle removing activity, the percentages indicated being by weight:

| | |
|---|---|
| Water | 67.86% |
| Ethyl Alcohol | 30.00% |
| Glycerine | 2.00% |
| Dimethicone[a] | 0.10% |
| Polyethyleneoxide nonylphenol | 0.03% |
| Fragrance | 0.01% |

[a]Dow Corning 225 Cosmetic - Grade Silicone Fluid

The de-wrinkling composition was packaged into aerosol cans with the addition of about 3.5 parts of a hydrocarbon propellant consisting of a blend of propane and isobutane per 100 parts of the composition. A conventional aerosol valve and actuator combination was used to generate a fine mist.

The de-wrinkling composition was applied to wrinkled garments composed of the following fabrics, spraying the wrinkled areas sufficiently to moisten the fabric:

100% cotton
60% cotton/40% polyester
65% polyester/35% cotton
100% rayon
100% silk
65% polyester/35% rayon
55% ramie/45% cotton
100% wool
100% nylon
50% polyester/50% cotton The composition was allowed to soak in for a few seconds, the treated fabric then being pulled taut and allowed to dry naturally.

The fabric de-wrinkling composition effectively removed wrinkles from all of the fabrics tested, leaving behind a smooth wrinkle-free fabric surface.

EXAMPLE 2

A de-wrinkling composition in accordance with the invention, comprising 75% water, 15% ethyl alcohol and 10% glycerine was compared to a preferred de-wrinkling composition described in U.S. Pat. No. 3,436,772 to Stebbins comprising 89% water, 9% isopropyl alcohol, 1% propylene glycol, 1% total acetone and methyl isobutyl ketone, and a trace of triethanolamine.

A panel test procedure was used for the comparative evaluation. Ten panelists compared treated 100% cotton shirts in a double-blind test protocol.

Identical white 100% cotton shirts were treated with a 20 second spray of the wrinkle removing composition and allowed to dry. Ten panelists evaluated each shirt in comparison with every other shirt in pairs and chose the shirt in each pair which had the better appearance. The shirts were then laundered and dried, and the test protocol repeated using a different treatment on each shirt until each shirt had been treated and evaluated for each composition.

The panelists evaluated the treated shirts by comparing the appearance of each pair hanging side by side at eye level in controlled lighting conditions, evaluating only two shirts at a time.

The panelists' preferences were recorded for each composition tested. The experimental protocol was then repeated and the mean score of the two tests calculated for each test composition. A T-test was performed on the mean scores to determine significant differences in efficacy between the treatments.

Based on statistical analysis of the results the 10% glycerine composition of the invention was superior in wrinkle removal at the 93% confidence level relative to the composition of the prior art.

EXAMPLE 3

The composition of the invention disclosed in Example 2 was compared with a commercially available wrinkle removing spray composition containing approximately 0.4% quaternary ammonium compound, 20% alcohol, and water.

The panel test procedure described in Example 2 was followed to compare the two compositions. The results indicate that the de-wrinkling performance of the composition of the invention was clearly preferred by the test panel as compared to the commercial de-wrinkling composition.

EXAMPLE 4

The efficacy of spraying a glycerine-water de-wrinkling composition onto damp fabrics in an operating clothes dryer in accordance with a previously described method of the invention was demonstrated as described below.

Six men's dress shirts composed of 60% cotton-40% polyester fabric were taken damp from the final spin of a conventional washing machine. These were placed into a conventional home clothes dryer and the dryer was caused to operate with the door open, by holding down the safety door switch. Into the operating dryer was sprayed, by means of a hand-operated pump sprayer, 153.9 grams of a 20% solution of glycerine in water. Following completion of the spraying operation, the dryer door was closed and the drying cycle was completed. The shirts were allowed to remain in the dryer for 10 minutes after the cycle was completed; then they were removed and hung on hangers. Under controlled lighting conditions, the group of shirts was given an average wrinkle score of 2.1 on a scale of 1=excellent to 5=very poor, by an experienced rating panel.

As a control experiment, the above-described procedure was repeated, except that a 100% water spray was used instead of a glycerine-water spray. The group of shirts was evaluated by a rating panel and given an average wrinkle score of 3.2, a significantly poorer score than that achieved with the glycerine-water de-wrinkling solution.

What is claimed is:

1. An aqueous composition for removing wrinkles from a fabric comprising:
   (a) from about 10 to 60%, by weight, of one or more alcohols selected from the group consisting of ethyl, propyl and isopropyl alcohols;
   (b) from about 1 to 10%, by weight, of glycerine;
   (c) a nonionic surfactant in an amount sufficient to enhance the wettability of the fabric, and;
   (d) the balance water 2. An aqueous composition in accordance with claim 1 further including at least 0.05%, by weight, of a polydimethyl siloxane polymer to reduce any tackiness imparted by said glycerine to said fabric.

3. An aqueous composition in accordance with claim 1 comprising: from about 25 to 35%, by weight, of said alcohol; from about 2 to 6%, by weight, of glycerine; and from about 0.01 to 0.2% by weight of nonionic surfactant.

4. A composition in accordance with claim 1, wherein the alcohol is ethyl alcohol.

5. A composition in accordance with claim 2 which comprises, by weight, about 30% ethyl alcohol, about 2% glycerine, about 0.1% of said silicone compound and about 0.03% of said nonionic surfactant.

6. A composition in accordance with claim 1 further including from about 1 to 10%, by weight, of a hydrocarbon propellant.

7. A composition in accordance with claim 5 further including about 3.0%, by weight, of a hydrocarbon propellant.

8. A method of removing wrinkles from a fabric comprising the steps of:

(a) providing, in the form of a spray, an aqueous composition comprising:
  (i) from about 10 to 60%, by weight, of an alcohol selected from the group consisting of ethyl, propyl and ispropyl alcohols;
  (ii) from about 1 to 10%, by weight, of glycerine;
  (iii) a nonionic surfactant in an amount sufficient to enhance the wettability of the fabric, and;
  (iv) the balance water
(b) applying an effective amount of said spray on the wrinkled fabric to be treated; and
(c) allowing the fabric to dry.

9. A method in accordance with claim 8 wherein said aqueous composition further includes at least 0.05%, by weight, of a polydimethyl siloxane polymer to reduce any tackiness imparted by said glycerine to said fabric.

10. A method in accordance with claim 9 wherein said composition comprises, by weight, about 30% ethyl alcohol, about 2% glycerine, about 0.1%, of said silicone compound and about 0.03%, of said nonionic surfactant.

11. A method in accordance with claim 8 including the step of providing the aqueous composition in a pressurized aerosol can, said composition further including from about 1 to 10%, by weight, of a hydrocarbon propellant.

12. A method in accordance with claim 11 wherein said composition further includes about 3.0%, by weight, of a hydrocarbon propellant.

13. A method of removing wrinkles from damp laundered fabrics comprising the steps of:

(a) inserting the wrinkled damp laundered fabrics into an automatic laundry dryer;
(b) providing in the form of a spray an aqueous composition comprising:
  (i) from about 5 to 40%, by weight, glycerine; and
  (ii) the balance water;
(c) applying an effective amount of said spray on the wrinkled fabrics in said laundry dryer; and
(d) allowing the fabrics to be dried in said laundry dryer.

14. A method in accordance with claim 13 wherein said spray is applied to the wrinkled fabrics from a dispenser in said laundry dryer.

15. A method in accordance with claim 13 wherein said aqueous composition contains from about 10 to 30%, by weight, glycerine.

* * * * *